US007055199B2

(12) United States Patent
Thompson

(10) Patent No.: US 7,055,199 B2
(45) Date of Patent: Jun. 6, 2006

(54) LUMBAR BACK SUPPORT DEVICE

(76) Inventor: Harlyn J. Thompson, 2306 NW. Schmidt Way, #6, Beaverton, OR (US) 97006

( * ) Notice: Subject to any disclaimer, the term of this patent is extended or adjusted under 35 U.S.C. 154(b) by 0 days.

(21) Appl. No.: 10/424,087

(22) Filed: Apr. 25, 2003

(65) Prior Publication Data

US 2004/0211004 A1 Oct. 28, 2004

(51) Int. Cl.
*A61F 5/34* (2006.01)

(52) U.S. Cl. ..... 5/655.3; 5/626; 5/644

(58) Field of Classification Search ..... 5/626 R, 5/655.3 X, 644, 708
See application file for complete search history.

(56) References Cited

U.S. PATENT DOCUMENTS

| | | | | |
|---|---|---|---|---|
| 2,077,233 | A | | 4/1937 | Greenhill |
| 4,207,633 | A | | 6/1980 | Smith et al. |
| 4,516,568 | A | | 5/1985 | Baxter et al. |
| 4,669,455 | A | | 6/1987 | Bellati |
| 5,201,761 | A | | 4/1993 | Serola |
| 5,245,719 | A | | 9/1993 | Ott |
| 5,711,575 | A | * | 1/1998 | Hand et al. ..... 297/284.6 |
| 5,713,841 | A | * | 2/1998 | Graham ..... 5/636 |
| 5,785,669 | A | | 7/1998 | Proctor et al. |
| 5,902,011 | A | * | 5/1999 | Hand et al. ..... 5/644 |
| 5,948,013 | A | * | 9/1999 | Swezey et al. ..... 5/636 |
| D419,495 | S | | 1/2000 | Muhanna |
| 6,138,306 | A | | 10/2000 | Muhanna |
| 6,227,201 | B1 | | 5/2001 | Ferko, III |
| 6,273,810 | B1 | * | 8/2001 | Rhodes et al. ..... 5/654 |
| 6,357,066 | B1 | | 3/2002 | Pierce |
| 6,385,802 | B1 | * | 5/2002 | Roberts et al. ..... 5/624 |
| 6,427,697 | B1 | | 8/2002 | Pearcey |
| 6,443,157 | B1 | | 9/2002 | Sargent |
| 6,468,205 | B1 | * | 10/2002 | Mollenauer et al. ..... 600/201 |

* cited by examiner

*Primary Examiner*—Frederick L. Lagman
(74) *Attorney, Agent, or Firm*—Kolisch Hartwell, P.C.

(57) ABSTRACT

A lumbar support pillow for supporting the lumbar spine of a person. The support pillow includes an elongate, fillable first chamber configured to engage and support a person along the longitudinal axis of the person's spine. The pillow may also include a fillable second chamber extending laterally on both sides of the first chamber, and configured to engage and support a person in a region laterally adjacent to the person's lumbar spine.

18 Claims, 4 Drawing Sheets

LUMBAR BACK SUPPORT DEVICE

FIELD OF THE INVENTION

The present invention relates generally to medical appliances, and more particularly to a lumbar support device for reducing lower back pain by supporting the lumbar region of a person's spine with an adjustable support pillow.

BACKGROUND OF THE INVENTION

In its position of natural homeostasis, the lower, or lumbar, region of the human spine is curved towards the front of the body (lordotic) when viewed from the side. When the lumbar region of the spine becomes curved away from this position of natural homeostasis, the resulting condition is generally termed lumbar lordosis, or hyperlordosis in cases of extreme curvature. One situation that may lead to departure from natural homeostasis in the lower back occurs when a person is required to maintain a relatively fixed lumbar position for a long period of time. For example, maintaining a seated, sloped, or supine position may force the lumbar region away from its natural lordotic curvature, leading to pain and/or limited movement.

There are numerous situations in which a person may be required to maintain a non-homeostatic lower back position. For example, patients recovering from surgery and/or undergoing medical procedures may have to remain in a supine position for a relatively long period of time, with little or no movement. Such medical procedures include cardiac catherization (angiogram), magnetic resonance imagery (MRI), echocardiogram (ECG), renal scanning, and various other imaging and/or testing procedures. In some cases, these procedures may require patients to lie completely still for 4–6 hours or more.

Additionally, women undergoing prolonged labor during childbirth, patients who have received external fixation to facilitate healing of broken bones, burn patients, victims being examined and/or transported after an accident, terminally ill patients, and permanently disabled patients, among others, may also be required to maintain a sloped or horizontal supine position for long periods of varying duration. During this time, patients may suffer considerable back pain, particularly in the lumbar region.

Perhaps even more commonly, a person sitting in a wheelchair, an office chair, an automobile seat, or an airplane seat may spend hours at a time in a relatively fixed position, with their lower back forced away from its natural lordotic curvature. Often, this leads to lumbar back pain and/or restricted range of movement. Prolonged maintenance of an anatomically incorrect posture while either supine or seated may lead to long-term misalignment of the spine, which often requires medical attention and which in some instances may not be easily reversible.

To ameliorate the back pain described above, drugs such as narcotic painkillers may be administered or taken. These drugs often are addictive, they typically decrease productivity in the workplace, and they may be unsafe when taken by a driver of a car or by an operator of machinery. Furthermore, narcotic painkillers may have numerous adverse medical side effects, including nausea, vomiting, low blood pressure, itching, confusion, accelerated heart rate, and constipation, among others.

An alternative to administering drugs is to attempt to mechanically provide lower back support, for example by pushing conventional pillows, towels, and the like behind or beneath the lower back. However, this action may require undesirable movement on the part of the user, and can interfere with medical testing procedures in cases where the user is a clinical patient. Furthermore, such mechanical means may not be designed to support the lumbar spine in an anatomically correct position. Therefore, existing mechanical measures may not result in substantial added comfort for the user, and in some instances may even exacerbate a medical condition.

In light of the above considerations, a need exists for a noninvasive, convenient, and comfortable device for supporting the lumbar spine of a person in a seated, sloped, or supine position.

SUMMARY OF THE INVENTION

The present invention provides a lumbar support pillow for supporting the lumbar spine of a person, and includes an elongate, fillable first chamber configured to engage and support a person along the longitudinal axis of the person's spine. The pillow may also include a fillable second chamber extending laterally on both sides of the first chamber, and configured to engage and support a person in a region laterally adjacent to the person's lumbar spine.

DETAILED DESCRIPTION OF THE PREFERRED EMBODIMENT

Figure 1:
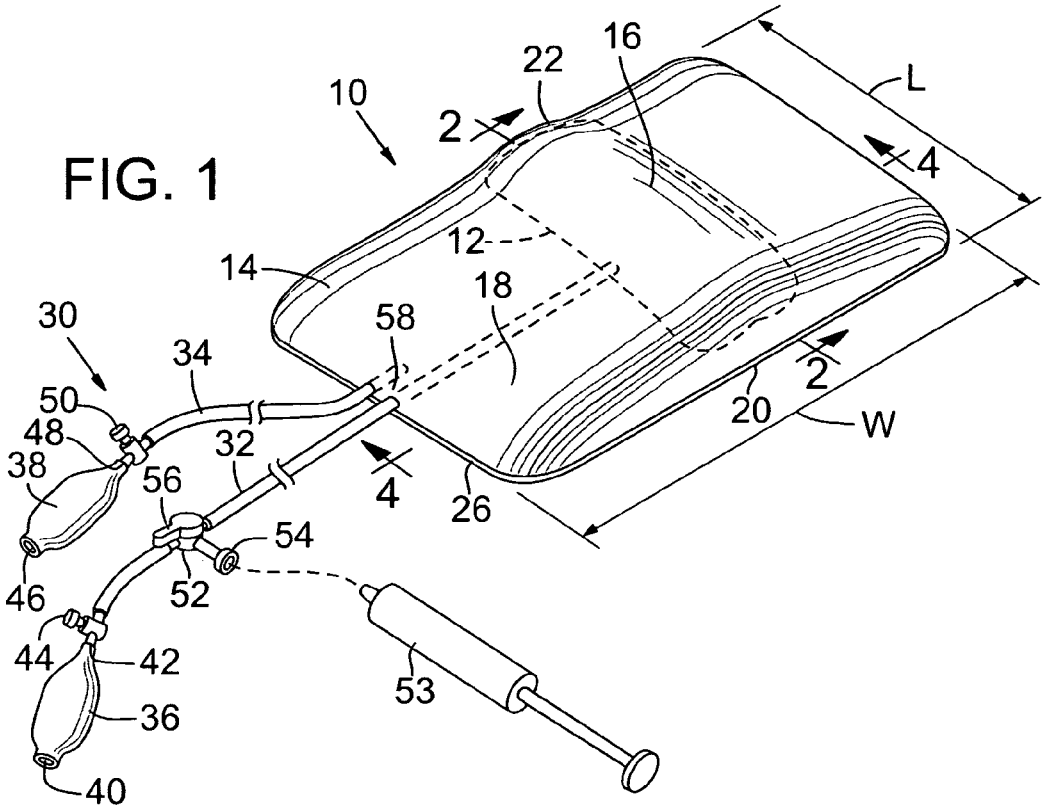
FIG. 1 is a perspective view of a lumbar support pillow, according to an embodiment of the invention.
Figure 2:
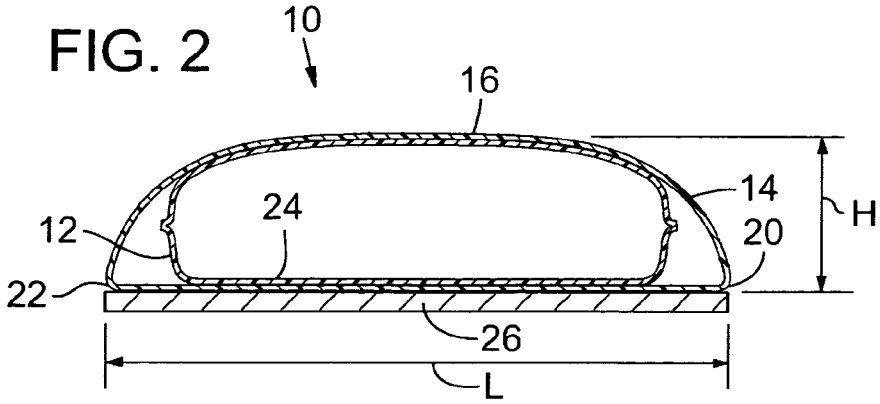
FIG. 2 is a side cross sectional view taken along lines 2—2 of the lumbar support pillow of FIG. 1

FIGS. 1 and 2 show a selectively fillable lumbar support pillow, generally indicated at 10, according to the present invention. Support pillow 10 includes a fillable central or spine support chamber 12, best seen in FIG. 2, and a fillable lateral chamber 14. Chambers 12 and 14 may be filled with a fluid such as a gas, a liquid, and/or a gel, as described in further detail below. In FIG. 1, both chambers are depicted as substantially completely filled.

Central chamber 12 is elongate, so that a support surface 16 near the center of the support pillow may be contoured by the central chamber. Support surface 16 is dimensioned to engage and support a person along the longitudinal axis of the person's spine, substantially conforming to and helping to maintain the natural curvature of the spine to provide lumbar support. As seen in FIG. 2, support surface 16 may be generally arcuate in shape when completely filled, thereby providing a substantially smooth interface for engaging and supporting the person's spine.

Support surface 16 may in some embodiments be partially pre-configured to substantially emulate the natural curvature of a human spine, so that the lumbar region of a person utilizing the invention may be supported in a position of relative homeostasis. Thus, as FIG. 2 indicates, support surface 16 may have height that varies symmetrically along its length. In other words, the height of the support surface may be substantially the same at any particular longitudinal distance inward from edge 20 of the lateral chamber, as its height at the same longitudinal distance inward from edge 22 of the lateral chamber. In addition, central chamber 12 may be selectively filled with fluid, so that the curvature of support surface 16 and/or the degree of lumbar support provided by central chamber 12 may be selectively varied.

Lateral chamber 14 extends laterally on both sides of central chamber 12, and is configured to provide expanses that engage and support a person in a region laterally adjacent to the person's lumbar spine. The lateral chamber thus provides lumbar support, and also enhances the rotational stability of a supine person lying on top of support pillow 10. As depicted in FIG. 1, an upper surface 18 of lateral chamber 14 curves downwardly and away from central chamber 12 when completely filled. Lateral chamber 14 may be selectively filled with fluid, so that the curvature of upper surface 18 and/or the degree of support provided by lateral chamber 14 may be selectively varied.

As shown in FIG. 1, central chamber 12 may in some embodiments be substantially enclosed by lateral chamber 14. This manner of construction may add to the comfort and durability of the support pillow by, for example, eliminating unnecessary external seams and/or gaps between the fillable chambers. As indicated, in such cases central chamber 12 may be nominally disposed near the center of lateral chamber 14, and may extend laterally to a relatively short distance from front edge 20 and rear edge 22 of the lateral chamber. For example, the central chamber may extend to within approximately ½" from edges 20 and 22 of the lateral chamber.

The spacing of the central chamber away from edges 20 and 22 of the lateral chamber enables expansion of the central chamber within the lateral chamber when the central chamber is inflated or filled with fluid. However, it should be appreciated that in other embodiments, it may be desirable to provide a central chamber that is not enclosed by the lateral chamber. In such cases, the central chamber may extend up to, or beyond, the edges of the lateral chamber.

Central chamber 12 and lateral chamber 14 may be constructed from any suitable material, including but not limited to synthetic polymer materials. Suitable synthetic polymers may include synthetic rubbers such as butyl rubber, neoprene, polybutadiene, latex, and the like, as well as combinations of these polymers in a layered or interwoven structure. In general, the chambers of the support pillow may be constructed from materials that are substantially impermeable to the fluids that may be used to fill them, which may include gases, liquids, and/or gels, among others.

FIG. 2 shows a cross section of the support pillow of FIG. 1, taken along lines 2—2. A bottom surface 24 of central chamber 12 may be attached to the inside of lateral chamber 14 by, for example, heat sealing or gluing, although any means that securely bonds bottom surface 24 to the lateral chamber may be suitable. The attachment of the two chambers helps to preserve their relative orientation, by keeping the central chamber disposed at or near the center of the lateral chamber. It will be appreciated, however, that other means of maintaining this orientation are possible, such as placing central chamber 12 and lateral chamber 14 in a case or other device that restricts their relative movement.

As shown in the drawings, in some embodiments the support pillow may also include a base member 26, preferably formed of a rigid material having a substantially flat bottom surface, to support central chamber 12 and lateral chamber 14 and to allow pillow 10 to slide between a supine patient and a horizontal surface with minimal friction. The periphery of the base member may be provided with rounded comers as shown in FIG. 1, to reduce the possibility of an edge of the base member accidentally tearing fabric or injuring a person handling or using the support pillow. The base member may be constructed from a relatively low-friction, thermoplastic polymer, such as a polypropylene or polyethylene plastic material. In general, any suitable, relatively rigid material may be used in the construction of the base member that facilitates supporting the fillable chambers and/or sliding the support pillow behind or beneath a person's lower back.

Central chamber 12 and/or lateral chamber 14 is secured to the base member by, for example, heat sealing and/or gluing, or by any other suitable connecting means. In some embodiments, there may be a connecting seal that connects lateral chamber 14 to base member 26 near a lower periphery of the lateral chamber. The connecting seal may extend substantially around the entirety of the lower periphery of the lateral chamber, attaching it firmly to the base member. The central chamber, which may be secured inside the lateral chamber as described previously, may not have an independent attachment to the base member. However, it should be appreciated that in some embodiments, the central chamber and the lateral chamber may be separately attached to the base member.

As shown in FIG. 1, support pillow 10 includes a fluid delivery mechanism, generally indicated at 30. The fluid delivery mechanism is provided with one or more fluid communication channels, such as flexible tubes 32 and 34, which are configured to deliver fluid from a fluid source to the fillable chambers of the support pillow. As shown in FIG. 1, tube 32 is oriented to deliver fluid to central chamber 12, and tube 34 is oriented to deliver fluid to lateral chamber 14, although other configurations are possible. For example, in some embodiments a single tube may deliver fluid to both chambers, if the tube is perforated to communicate fluid to each chamber. Alternatively, a single tube that bifurcates into two tubes may be used.

In some embodiments, fluid may be delivered through the tubes and into the fillable chambers by actuating depressible bulbs 36 and 38. In the embodiment depicted in FIG. 1, bulb 36 is attached to tube 32, and bulb 38 is attached to tube 34, so that the fillable chambers are independently fillable through selective use of the bulbs. Bulbs 36 and 38 may be, for example, standard bulbs of a type known to medical practitioners and employed in sphygmomanometers (blood pressure measuring devices), among other devices. The bulbs may be constructed from any elastic material, such as rubber or a synthetic polymer material, that is substantially impermeable to the fluid used in the support pillow. To distinguish the bulbs from each other, one may be a slightly different size and/or color than the other.

Bulbs 36 and 38 may each be equipped with one or more valves to selectively permit ingress and egress of fluid into and out of the fillable chambers. For example, the bulbs and their associated valves may be configured to permit fluid to be drawn into the bulbs from an external source, to deliver fluid to the fillable chambers of the support pillow through fluid communication channels such as tubes 32 and 34, and/or to selectively release fluid from the filled chambers. In this manner, the amount and pressure of fluid within the fillable chambers, as well as the curvature of the chambers, may be controllable.

For example, bulb 36 may have a one-way valve 40 located near its distal end, and another one-way valve 42 located near its proximal end. Valve 40 permits inflow of fluid through the distal end of the bulb, but restricts outflow. If the bulb is compressed and released, a partial vacuum formed within the bulb causes fluid to be drawn into the bulb through valve 40. Valve 42 permits outflow of fluid through the proximal end of bulb 36, but restricts inflow. Therefore, when the bulb is compressed, fluid within the bulb exits through valve 42 (but not through valve 40), and passes to central chamber 12 through tube 32. However, passage of fluid from the chamber 12 back to bulb 36 may be restricted by the one-way nature of valve 42. In this manner, bulb 36 may be repeatedly compressed to fill chamber 12 of the lumbar support pillow with any desired amount of fluid.

Bulb 36 may also have an egress valve 44 located near its proximal end, configured to selectively permit egress of fluid from central chamber 12 of the support pillow. Egress valve 44 preferably is located between valve 42 and central chamber 12, so that valve 42 cannot restrict passage of fluid from chamber 12 to the egress valve. Therefore, upon opening egress valve 44, fluid may pass out of the central chamber, through tube 32, and through the egress valve. In other words, egress valve 44 may be used to selectively deflate fillable central chamber 12. Egress valve 44 may have a push-button design to facilitate one-handed operation, although other designs, such as a rotating valve head, may be suitable.

Bulb 38 may be equipped with valves in a manner analogous to the configuration of bulb 36. Thus, for example, bulb 38 may include a pair of one-way valves 46 and 48 to facilitate passage of fluid to lateral chamber 14, and an egress valve 50 to selectively permit egress of fluid from lateral chamber 14. Valves 46, 48, and 50 may be similar in design and construction to valves 40, 42, and 44, including a push-button or other convenient design for egress valve 50.

As shown in FIG. 1, fluid delivery mechanism 30 may also include a valve 52 disposed along flexible tube 32, for injecting fluid into central chamber 12 with a syringe 53. Valve 52 may be compatible with a syringe in a manner familiar to those skilled in the art of intravenous injections; for example, valve 52 may include a syringe port 54 configured to selectively receive fluid from a syringe, and a stopcock mechanism 56 for adjusting the fluid communication path allowed by the valve. In the position shown in FIG. 1, the stopcock mechanism allows fluid communication between bulb 36 and central chamber 12, and in another position (not shown) it allows fluid communication between the syringe and the central chamber. Thus, bulb 36 and syringe port 54 may be used interchangeably in conjunction with valve 52, to supply fluid to the central chamber. In some embodiments, a similar valve and stopcock mechanism may be used to selectively deliver fluid to lateral chamber 14 as well.

In another embodiment, the fluid delivery mechanism may include an additional valve (not shown) disposed along tube 32, near an entry region 58 where the tubes enter the lateral chamber. This additional valve may be similar in construction to valve 52, including an entry port and a stopcock mechanism, but it may be configured to receive a fluid gel that may be squeezed from a pouch. For example, a glycerine-based gel or a cellulose-based gel may be used to fill central chamber 12 in this manner. Such a non-toxic fluid gel may be safely cooled in a household freezer and/or heated in a household microwave oven, allowing for convenient adjustments to the temperature of the gel prior to insertion in the lumbar support pillow.

In still another embodiment, fluid may be delivered to one or both of chambers 12 and 14 by a mechanized pump (not shown), such as an electrically powered pneumatic compression pump. Similar pumps are commonly used in medical devices designed, for example, to promote post-operative blood circulation. Such a mechanized pump may be configured to supply a fluid, such as air, to the lumbar support pillow in an automated fashion. For example, the mechanized pump may be equipped with a pressure sensor, and may be configured to supply fluid to the lateral and/or central chamber up to a pressure that may be preset by a user. The mechanized pump may be further configured to supply fluid periodically, in a pulsating manner that may have a massaging or similarly therapeutic effect on a user's lower back.

As shown in FIG. 1, tubes 32 and 34 may enter the fillable chambers at entry region 58, which may be substantially centered along the length of the lateral chamber. The tubes may have lengths chosen so that the bulbs may be placed in positions adjacent to a seated or supine person, and may be easily accessible by one of the person's hands and/or by an attendant. For example, tube 32 may be approximately 22" long, and tube 34 may be approximately 24" long. A slight difference in length of the tubes may allow a user and/or an attendant to easily distinguish the tubes from each other, in order to identify which chamber each tube communicates with.

The diameters of the tubes may be chosen to provide a suitable flow of fluid to the fillable chambers. For example, each tube may have an inner diameter of approximately 3/16" and an outer diameter of approximately 5/16", although other diameters may be appropriate in some embodiments. Placement of the tubes at entry region 58 may allow both right-handed and left-handed users to have equally convenient access to the bulbs and egress valves, by rotating the support pillow to position the entry region on the dominant side of the person's body. In general, any configuration is suitable that allows a user and/or an attendant to conveniently adjust the fluid pressure in the fillable chambers. Preferably, the adjustment may be made without requiring significant motion of the user.

The dimensions of the support pillow and its components generally may be chosen to facilitate their comfort and convenient use, and it may be desirable to provide several sizes of support pillows so that the most appropriate size may be chosen for a given application. Specifically, it may be desirable to provide sizes suitable for use by people of varying heights and/or weights. The charts below provide examples of possible approximate dimensions of the central chamber, the lateral chamber, and the base member in various embodiments.

In the charts, "Length L" refers to the direction parallel to the longitudinal axis of the central chamber, "Width W" refers to the direction perpendicular to the length and in the plane of the base member, and "Height H" refers to the direction orthogonal to the plane of the base member. As an example, the length, width, and height of lateral chamber 14 are indicated as "L", "W", and "H", respectively, in FIGS. 1 and 2. In general, the heights of the fillable chambers refer to their approximate heights when substantially filled with fluid.

| | Central chamber 12 | Lateral chamber 14 | Base member 26 |
|---|---|---|---|
| | Size A (short) | | |
| Length L | 5" | 6" | 6" |
| Width W | 2" | 12" | 12" |
| Height H | 2" | 2" | 0.125" |
| | Size AA (short/obese) | | |
| Length L | 5" | 6" | 6" |
| Width W | 3" | 16" | 16" |
| Height H | 3" | 3" | 0.125" |
| | Size AAA (short/morbidly obese) | | |
| Length L | 5" | 6" | 6" |
| Width W | 4" | 20" | 20" |
| Height H | 4" | 4" | 0.125" |
| | Size B (medium height) | | |
| Length L | 6" | 7" | 7" |
| Width W | 2.5" | 14" | 14" |
| Height H | 2.5" | 2.5" | 0.125" |
| | Size BB (medium height/obese) | | |
| Length L | 6" | 7" | 7" |
| Width W | 3" | 18" | 18" |
| Height H | 3" | 3" | 0.125" |
| | Size BBB (medium height/morbidly obese) | | |
| Length L | 6" | 7" | 7" |
| Width W | 4" | 22" | 22" |
| Height H | 4" | 4" | 0.125" |
| | Size C (tall) | | |
| Length L | 8" | 9" | 9" |
| Width W | 3" | 17" | 17" |
| Height H | 3" | 3" | 0.125" |
| | Size CC (tall/obese) | | |
| Length L | 8" | 9" | 9" |
| Width W | 4" | 20" | 20" |
| Height H | 4" | 4" | 0.125" |
| | Size CCC (tall/morbidly obese) | | |
| Length L | 8" | 9" | 9" |
| Width W | 5" | 24" | 24" |
| Height H | 5" | 5" | 0.125" |

Figure 3:
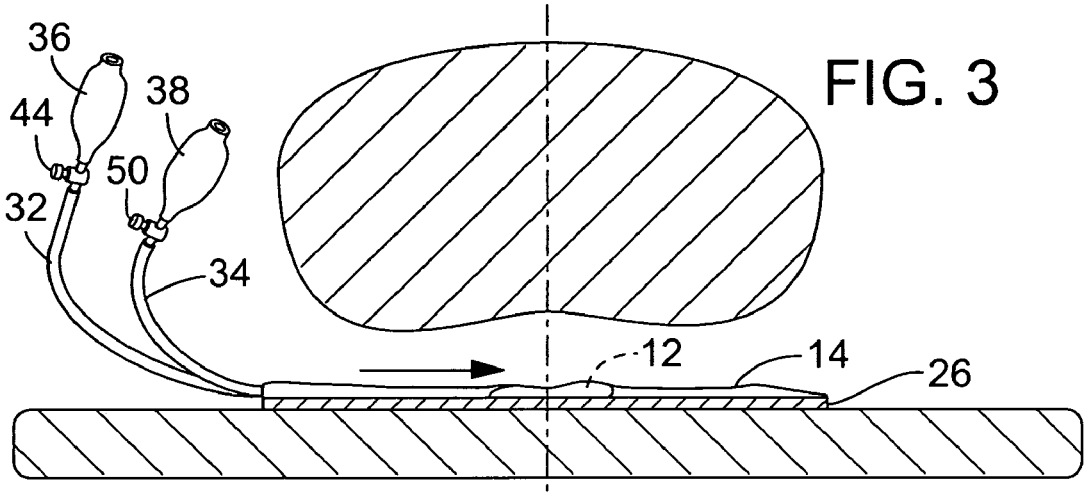
FIG. 3 is a front cross sectional view of an uninflated lumbar support pillow sliding beneath a supine patient on a horizontal surface, according to an embodiment of the invention.

FIG. 3 shows a front cross sectional view of lumbar support pillow 10 sliding under a supine person, prior to filling chambers 12 and 14. As depicted in FIG. 3, the support pillow may be constructed to lie substantially flat before the chambers are filled, facilitating its placement under the back of a supine person. Substantially rigid construction of base member 26 may further allow the support pillow to slide under a supine person with little or no movement of the person. This may, for example, permit the pillow to be positioned under a person undergoing a medical testing procedure without interrupting the procedure.

Figure 4:
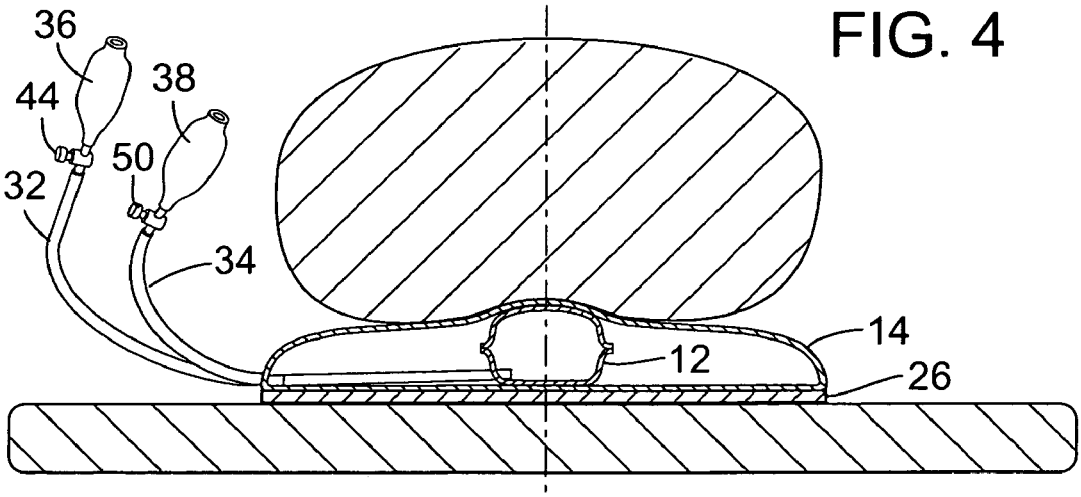
FIG. 4 is another front cross sectional view of the lumbar support pillow of FIG. 3, where the pillow has been inflated to support the lumbar region of the supine patient.
Figure 5:
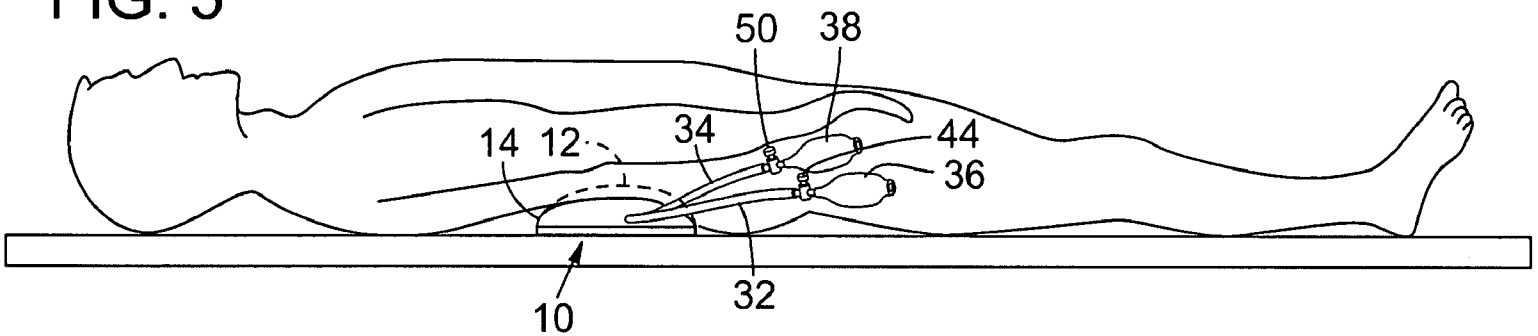
FIG. 5 is a side elevational view of the lumbar support pillow and patient of FIG. 4, showing possible adjustment of the amount of fluid in the pillow.
Figure 6:
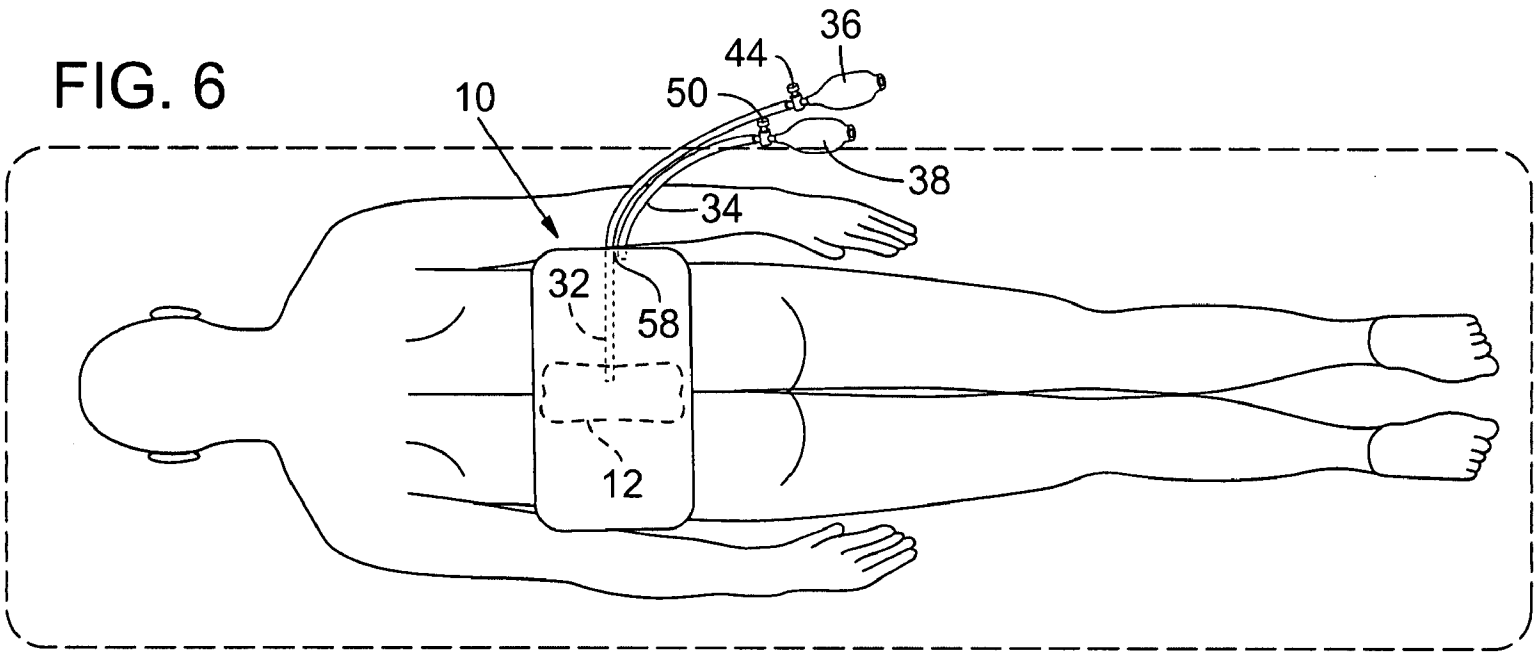
FIG. 6 is a bottom view of the lumbar support pillow and patient of FIGS. 4–5, showing alignment of a central chamber of the pillow with the longitudinal axis of the patient's spine.

FIGS. 4–6 show lumbar support pillow 10 supporting the lumbar region of a supine person, after chambers 12 and 14 have been at least partially filled with fluid. As may be best seen in FIGS. 4 and 6, central chamber 12 may be configured to engage and support a supine person substantially along the longitudinal axis of the person's spine, and lateral chamber 14 may be configured to engage and support a person in a region laterally adjacent to the person's lumbar spine.

As may be best seen in FIGS. 5 and 6, the lengths of tubes 32 and 34 may be chosen such that bulbs 36 and 38 may be proximally disposed in relation to one of a supine user's hands. Thus, a supine user may use the bulbs and/or egress valves 44 and 50 to adjust the amount of fluid in the back pillow. As depicted, one of the tubes may have a slightly greater length than the other, allowing a supine user to distinguish the tubes. This may allow the user to selectively fill chambers 12 and 14 independently, without unnecessary motion. In particular, a supine person may remain supine while adjusting the fluid levels in the chambers.

Figure 7:
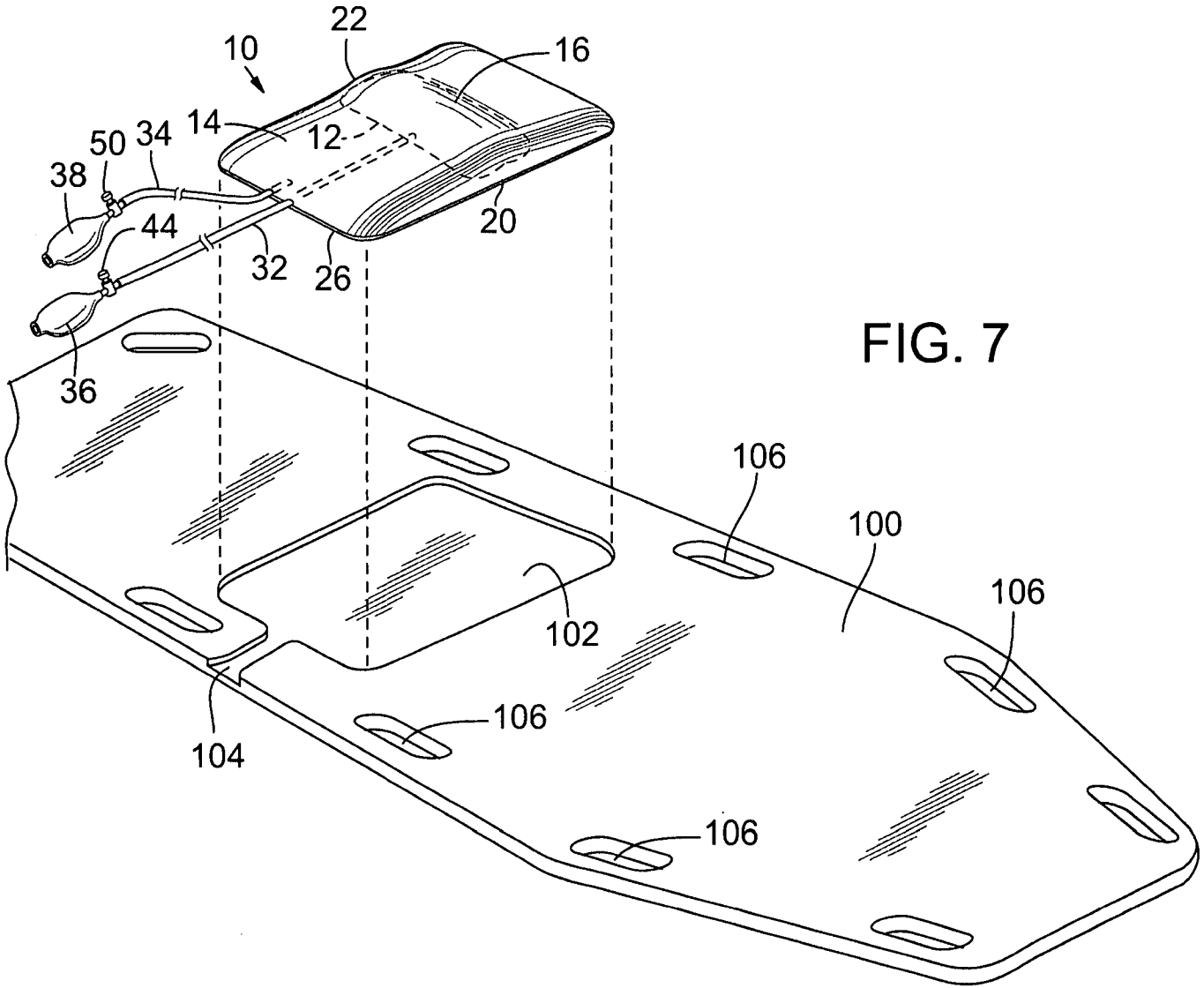
FIG. 7 is a perspective view of a lumbar support pillow and a medical backboard, showing positioning of the support pillow within a recess in the backboard according to an embodiment of the invention.

In some embodiments, it may be desirable to incorporate the lumbar support pillow of the present invention into a table, a chair, or any other object that includes a surface of contact for the lumbar spine. For example, FIG. 7 depicts lumbar support pillow 10 interfaced with an emergency medical backboard 100 such as might be used to transport victims from the scene of an accident (see also Example 2 below). Similarly, a lumbar support pillow according to the present invention might be provided as an integral part of any medical examining table such as an MRI table, a CT table, or an x-ray table, among others. Massage tables, automobile seats, reclining chairs, and wheelchairs represent further possible structures into which the lumbar support pillow may be integrally formed, according to aspects of the invention.

In some embodiments, the base member and the fillable chambers may be covered by a removable pillowcase (not shown). The pillowcase may be tailored to the general size and shape of the support pillow, and pillowcases of various sizes may be provided for embodiments of various sizes, such as those described above. The pillowcase may substantially enclose the fillable chambers and base member, and may have one side left open. The open side facilitates installation and removal of the pillowcase, and allows the fluid delivery tubes to extend from the fillable chambers and out of the pillowcase. The pillowcase may be constructed from materials that promote the comfort and ease of use of the support pillow. For example, the bottom surface of the pillowcase may be constructed from a thin plastic material to facilitate sliding the support pillow behind or beneath a person's lumbar spine, and/or the top surface of the pillowcase may be constructed from a soft, absorbent material to provide optimal comfort and to absorb sweat.

Generally, the components of the lumbar support pillow of the present invention may be constructed of any suitable materials or combinations of materials, such as those specifically noted above. It should be appreciated, however, that in some embodiments, particularly those used in medical facilities such as clinics and/or hospitals, it may be desirable to construct the support pillow from specific materials that have been approved by one or more regulatory agencies. For example, in the United States, it may be desirable to construct the support pillow from materials that have been approved by the Food and Drug Administration (FDA). Such FDA-approved materials may have undergone strict testing procedures to ensure their safety in clinical environments, and/or in emergency medical situations.

EXAMPLE 1

This example illustrates a possible method of use of the support pillow of the present invention in a clinical setting, where a patient is undergoing medical testing requiring them to maintain a horizontal supine position for a prolonged period of time.

Referring to FIGS. 3–6, the fillable chambers of support pillow 10 initially may be substantially empty, to simplify positioning the support pillow under a supine patient. A pillowcase as described previously is placed to nominally enclose the fillable chambers and base member, with tubes 32 and 34 and other components of fluid delivery mechanism 30 protruding from an opening along one side of the pillowcase. The support pillow is slid under the supine patient's torso, such that central chamber 12 is approximately aligned with the patient's lumbar spine. This alignment may be checked by inspection, and adjusted as necessary. The placement of the support pillow preferably may be accomplished with relatively little motion of the supine patient.

Once the support pillow is positioned properly as described above, lateral chamber 14 is filled with fluid. This may be conveniently accomplished, for instance, by squeezing bulb 38 repeatedly. When an appropriate level of fluid in the lateral chamber is attained, as determined by the supine patient and/or an attendant, filling of central chamber 12 commences. This may be accomplished through the use of bulb 36 and/or by injecting fluid into syringe port 54 (see FIG. 1), until the central chamber has been filled to a comfortable level. Note that one or both of bulbs 36 and 38 may have their distal ends in fluid communication with a gas (such as air), a liquid (such as water), or a gel, among others, so that the fillable chambers may be selectively filled with any desired fluid. In some instances, it may be desirable to heat or cool the fluid before filling the chambers.

In some embodiments, the fluid delivery mechanism includes a pressure sensitive gauge (not shown) on bulb 36 of central chamber 12. The gauge may be used by an attendant such as a nurse, to identify a safe pressure in the central chamber for patients who might have an existing spine injury. In this manner, for example, back surgery patients may be provided with a carefully monitored and safe amount of support to their lumbar spine, while being transported by backboard or stretcher to and/or from surgery.

Adjustments to the level of fluid in each fillable chamber are made through selective use of bulbs 36 and 38, and egress valves 44 and 50. Note that bulbs 36 and 38, and egress valves 44 and 50, are oriented to be within easy reach of the supine patient lying on the support pillow. Thus, the supine patient may independently adjust the fluid level of each chamber conveniently, and with relatively little motion. Slight adjustments over a period of time may increase the comfort level of the patient. Prior to removing the support pillow from under the supine patient's body, the fillable chambers may be partially or completely emptied using egress valves 44 and 50, so that the pillow may be removed easily and safely.

EXAMPLE 2

This example illustrates how the support pillow of the present invention may be used in conjunction with a medical backboard in an emergency situation.

As shown in FIG. 7, a rigid stretcher or medical backboard 100 is commonly used to immobilize and transport an injured person. Using backboard 100, the person may be transported to a medical facility, such as a hospital, without inducing additional injury or trauma to the person while moving them. Upon arrival at the hospital, the injured person may remain on the backboard for a substantial period of time, while waiting for medical attention and/or until medical tests indicate that it is safe to move the person off of the backboard. During the period of immobilization, the injured person may experience unnecessary pain and discomfort due to the hard and flat nature of the backboard to which they are attached.

Commonly, a blanket is placed on the backboard so that it will be positioned under the injured person, but the blanket may not maintain its position, and may not provide anatomically correct back support in any case. Padding may be provided as a permanent feature of the backboard, but this adds bulk and weight to the backboard, which may be undesirable in an emergency situation where time and space may be at a premium. Furthermore, such permanent padding may not be adjustable, so that it may not provide anatomically correct back support for patients of differing anatomies.

In one embodiment, the support pillow of the present invention may be slid under a person on a backboard in substantially the same manner as in a clinical setting, i.e. as described in Example 1. However, in another embodiment, the support pillow may be provided as an integral part of a backboard. For example, as depicted in FIG. 7, support pillow 10 may be installed in a shallow recess 102 in backboard 100, so that the top surface of the support pillow is substantially flush with the top of the backboard when the chambers of the support pillow are unfilled.

Recess 102 may be substantially centered across the width of backboard 100, and may be positioned in a region approximately coinciding with the lumbar region of a person disposed on the backboard. In some instances, the longitudinal position of the support pillow be adjustable with one or more handles, levers, or the like (not shown), so that the support pillow may be additionally aligned with the lumbar spine of a person lying on the backboard. A lateral portion 104 of recess 102 allows tubes 32 and 34 to extend to the edge of backboard 100 without crimping the tubes. Typically, the backboard may include a number of apertures 106 and/or straps (not shown), to enable manually lifting and transporting the backboard. Lateral portion 104 may be positioned so as to minimize or eliminate interference with these apertures and/or straps.

The support pillow may be installed in the backboard with its chambers unfilled, so that its upper surface is substantially level, or flush, with the top surface of the backboard. In this manner, the presence of the support pillow may not inhibit placement of an injured person onto the backboard. However, upon a determination by an emergency attendant that it is safe and appropriate to do so, the support pillow may be inflated to a desired level in a manner described previously. This will often lead to increased comfort of the injured person during transport, and/or before they are removed from the backboard in a medical facility. Prior to removal of the person from the backboard, it may be desirable to deflate the fillable cushions, for example using egress valves 44 and 50, as already described.

While the specific examples presented above represent typical methods of using the lumbar support pillow of the invention, the most general method of using the pillow to nominally maintain homeostasis of person's lumbar spine is much simpler. The method includes providing a lumbar support pillow according to the present invention in a location between a person's lumbar spine and a substantially flat surface, and at least partially filling the central chamber with fluid. In cases where the person is immobilized for any reason, providing the pillow may include sliding it between the flat surface and the person's lumbar region. An optional step is to also at least partially fill the lateral chamber with fluid.

While the present description has been provided with reference to the foregoing embodiments, those skilled in the art will understand that many variations may be made therein without departing from the spirit and scope defined in the following claims. The description should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element or the equivalent thereof, such claims should be understood to include incorporation of one or more such elements, neither requiring, nor excluding, two or more such elements.

I claim:

1. A lumbar support pillow for supporting the lumbar spine of a person, comprising:

an elongate fillable first chamber configured to engage and support a person along the longitudinal axis of the person's lumbar spine in a manner substantially conforming to the natural curvature of the spine when filled; and a fillable second chamber extending laterally on both sides of the first chamber, extending downwardly and away from the first chamber, and configured to engage and support a person in a region laterally adjacent to the person's lumbar spine when filled;

wherein the pillow includes an arcuate support surface having height that varies symmetrically along its length.

2. The lumbar support pillow of claim 1, wherein the first and second chambers are independently fillable.

3. The lumbar support pillow of claim 2, further comprising a fluid delivery mechanism configured to selectively deliver fluid to the first and second chambers.

4. The lumbar support pillow of claim 3, wherein the fluid delivery mechanism includes at least one fluid communication channel configured to deliver fluid from a fluid source to the fillable chambers.

5. The lumbar support pillow of claim 4, wherein the at least one fluid communication channel includes a first tube configured to deliver fluid to the first chamber, and a second tube configured to deliver fluid to the second chamber.

6. The lumbar support pillow of claim 5, wherein the fluid delivery mechanism includes at least one valve configured to selectively permit egress of fluid from the fillable chambers.

7. The lumbar support pillow of claim 6, wherein the fluid delivery mechanism includes at least one bulb for selectively delivering fluid into one of the tubes.

8. The lumbar support pillow of claim 7, wherein the at least one bulb includes a first bulb configured to selectively deliver fluid into the first tube, and a second bulb configured to selectively deliver fluid into the second tube.

9. The lumbar support pillow of claim 8, wherein the at least one valve includes a first valve configured to selectively permit egress of fluid from the first chamber, and a second valve configured to selectively permit egress of fluid from the second chamber.

10. The lumbar support pillow of claim 9, wherein the first chamber is substantially enclosed by the second chamber.

11. The lumbar support pillow of claim 6, wherein the fluid delivery mechanism includes a syringe port configured to receive fluid from a syringe.

12. The lumbar support pillow of claim 11, wherein the syringe port is attached to a stopcock mechanism configured to selectively allow passage of fluid between the syringe and the first chamber.

13. A medical backboard apparatus comprising:

a board member having a top, a bottom, a head portion, and a foot portion; and a lumbar support pillow attached to the board member; wherein the lumbar support pillow includes an elongate fillable first chamber configured to engage and support a person disposed on the board member along the longitudinal axis of the person's lumbar spine in a manner substantially conforming to the natural curvature of the spine when filled, and a fillable second chamber extending laterally on both sides of the first chamber, extending downwardly and away from the first chamber, and configured to engage and support a person disposed on the board in a region laterally adjacent to the person's lumbar spine when filled.

14. The medical backboard apparatus of claim 13, wherein the lumbar support pillow is disposed in a recess in the board member such that a top surface of the support pillow is substantially flush with the top of the board member when the chambers of the support pillow are unfilled.

15. The medical backboard apparatus of claim 13, wherein the lumbar support pillow further includes a fluid delivery mechanism configured to selectively deliver fluid to the fillable chambers.

16. The medical backboard apparatus of claim 15, wherein the fluid delivery mechanism is configured to independently deliver fluid to the fillable chambers.

17. The medical backboard apparatus of claim 16, where the fluid delivery mechanism includes at least one bulb for selectively delivering fluid to one of the fillable chambers.

18. A method of nominally maintaining homeostasis of a person's lumbar spine, comprising:

providing a lumbar support pillow in a region between the person's lumbar spine and a substantially flat surface, the pillow including:

an elongate fillable first chamber configured to engage and support a person along the longitudinal axis of the person's lumbar spine in a manner substantially conforming to the natural curvature of the spine when filled; and a fillable second chamber extending laterally on both sides of the first chamber, extending downwardly and away from the first chamber, and configured to engage and support a person in a region laterally adjacent to the person's lumbar spine when filled;

wherein the pillow includes an arcuate support surface having height that varies symmetrically along its length;

filling the first chamber at least partially with fluid; and filling the second chamber at least partially with fluid.

* * * * *